United States Patent [19]

Abrams

[11] 4,142,092

[45] Feb. 27, 1979

[54] REFRIGERATOR CABINET CASE HEATER INSTALLATION

[75] Inventor: Donald W. Abrams, Atlanta, Ga.

[73] Assignee: General Electric Company, Louisville, Ky.

[21] Appl. No.: 867,206

[22] Filed: Jan. 5, 1978

[51] Int. Cl.[2] ..... H05B 1/00

[52] U.S. Cl. ..... 219/218; 62/150; 62/275

[58] Field of Search ..... 219/218, 522; 62/275, 62/148, 150, 176, 248; 49/70

[56] References Cited

U.S. PATENT DOCUMENTS

| | | | |
|---|---|---|---|
| 2,731,804 | 1/1956 | Grubbs, Sr. | 62/275 X |
| 2,807,942 | 10/1957 | Dahlgren | 62/275 X |
| 2,809,402 | 10/1957 | Southworth | 219/218 X |
| 3,038,319 | 6/1962 | Kesling | 62/275 |
| 3,254,503 | 6/1966 | Rundell | 49/70 X |
| 3,869,873 | 3/1975 | Thomas | 62/275 |

*Primary Examiner*—C. L. Albritton
*Attorney, Agent, or Firm*—Frederick P. Weidner; Radford M. Reams

[57] ABSTRACT

A cabinet heater installation particularly adapted for field repair of refrigerator cabinet warming heaters or for a supplemental cabinet heater for severe humidity conditions. The installation includes a heater element installed about the exterior lateral and top surfaces of the cabinet outer case adjacent the outer case reentrant flanges. The heater cable is housed within a protective and decorative trim channel secured to the cabinet outer case. The electrical leads for the heating element pass into the machine compartment for connections to the power supply through openings located beneath the trim channel.

14 Claims, 3 Drawing Figures

REFRIGERATOR CABINET CASE HEATER INSTALLATION

BACKGROUND DISCUSSION

This invention concerns refrigerators and more particularly refrigerator cabinet warming heater installations. It is common practice in modern refrigerator designs to include cabinet heating devices to warm those portions of the refrigerator cabinet which are subject to formation of condensate or sweat on the exterior surfaces due to the cabinet surface being chilled below the dew point of the ambient air. These cabinet portions include the refrigerator outer case surfaces in the region of the reentrant flange of the outer steel case, since the reentrant flange which extends inwardly to join the liner or the breaker strip creates relatively high thermal conduction at this point. The high efficiency insulation found in modern refrigerators also allows relatively thin cabinet wall thicknesses, aggravating this problem.

Accordingly, it has been found necessary to provide auxiliary heaters to prevent this condensate formation.

The typical approach involves the installation of resistance heater wires extending within the outer case adjacent the reentrant flange at the point where it meets the steel outer case if the cabinet design is such as to use a breaker strip. Or, if a plastic liner construction is used, at the region where the flange of the plastic liner abuts the inside walls of the steel outer case. Many refrigerator cabinets utilize foamed-in cabinet insulation and in these designs commonly the heater element is encased within the foamed insulation. Electrical heaters are of course subject to occasional failure and these above-described designs create considerable difficulties in the repair of such units.

Firstly, the disassembly of the cabinet presents considerable difficulties in the removal of the breaker strips and other cabinetry components and the removal of the foamed-in heater element is next to impossible.

In order to overcome these difficulties, sometimes a redundant heater element is installed together with one connected to the refrigerator wiring and in the event the connected heater fails, a field repairman may merely connect the redundant heater. If the redundant heater fails, the problem of replacing it must then be faced. In addition, the use of two heater cables obviously increases the manufacturing costs of the refrigerator.

A second approach has involved the foaming-in of a heater tube within the case, which allows the heating cable to be removed and a replacement heating element snaked into the tube. However, some cabinet configurations preclude this approach and even with those cabinets which allow this repair procedure to be carried out, it is a relatively difficult process. There are situations therefore in which the only practical alternative is the scrapping of the unit which obviously is to be avoided if it is at all possible.

In certain situations with very high humidity atmospheric conditions, cabinet sweating may still occur even though the cabinet case heater is functioning properly. In those relatively exceptional situations, it would be advantageous to be able to modify the refrigerator cabinet heating arrangement in the field so as to correct the cabinet sweating. However, cabinet designs as described are such that disassembly of the cabinet components is difficult and the installation of a supplemental heat device would be difficult due to the presence of foamed insulation completely occupying the interior spaces.

It is accordingly an object of the present invention to provide a refrigerator cabinet heater installation which may be installed in the field to replace heaters which are originally installed within the interior of the refrigerator outer case which does not require disassembly of the cabinet or removal of the heating element from the foamed-in insulation.

It is yet another object of the present invention to provide a refrigerator cabinet casing heating installation which may be installed to supplement the casing heating arrangement included in the design as manufactured to correct chronic cabinet sweating in high humidity conditions.

SUMMARY OF THE INVENTION

These and other objects of the present invention, which will become apparent upon a reading of the following specification and claims, are accomplished by a cabinet heater installation comprised of an electrical heating element secured to exterior exposed surfaces of the cabinet about the sides and top thereof adjacent the reentrant flanges of the refrigerator outer casing. The heater element is enclosed within a decorative trim channel strip or otherwise given a design treatment to produce an acceptable aesthetic appearance of the finished installation. The electrical leads required for energizing the heating element extend through a casing opening adjacent the equipment compartment which are covered by the trim channel strip. The heating element is preferably secured to the cabinet by a self-adhesive foil strip which serves to secure the heat cable and improve the transfer of heat into the surrounding outer case structure.

The trim strip may be secured to the cabinet by means of screws or concealed clips secured to the refrigerator outer casing.

DETAILED DESCRIPTION

Figure 1:
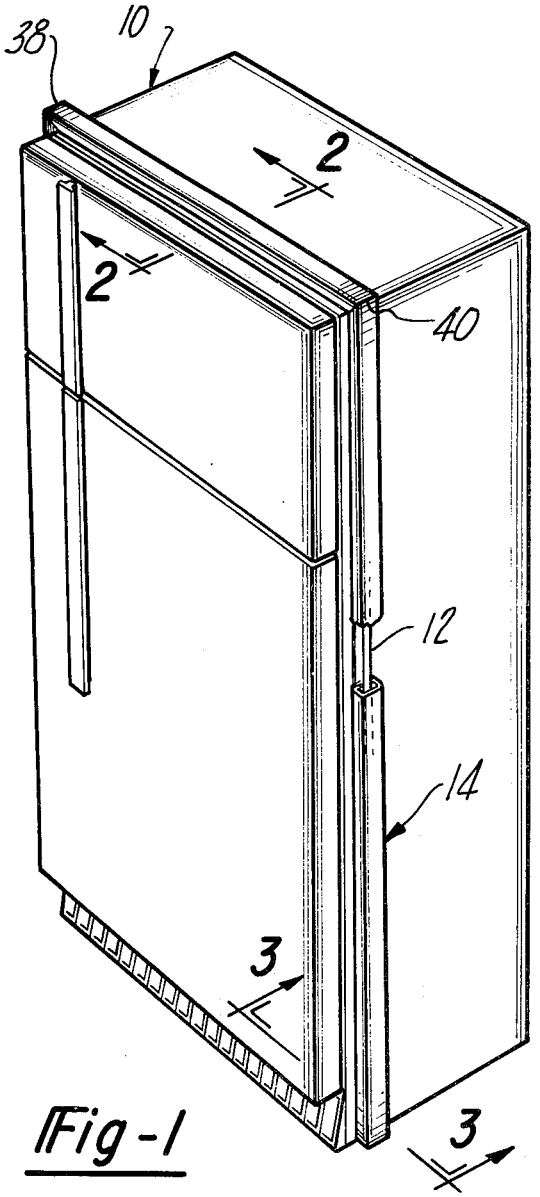
FIG. 1 is a perspective view of a refrigerator cabinet having a cabinet warming installation in accordance with the concept of the present invention.

In the following detailed description, certain specific terminology will be utilized for the sake of clarity and a specific embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the concept of the present invention calls for the installation on the exterior lateral surfaces of the refrigerator cabinet of an electrical heater element and enclosing the heater element within a decorative trim channel to protect the heater element and to create an acceptable aesthetic appearance of the completed installation.

These surfaces are typically the reentrant flange surfaces which are adjacent the "sweat" prone exterior surfaces. The refrigerator cabinet 10 includes a frontal access door 11 which moves into sealing engagement with front surfaces of the refrigerator cabinet 10. These areas are thus provided with heating element 26 which is typically formed into the interior space adjacent the reentrant flange 24 or the liner flange if a one-piece plastic liner is utilized.

If the resistance heater 26 fails, or is inadequate, the present concept calls for an electrical resistance heater 12 to be secured to the outer exterior top and side surfaces of the refrigerator cabinet 10 along the periphery of the case adjacent the door sealing areas of the face of the cabinet 10. The electric resistance heater element 12 passes about the periphery of the refrigerator outer case 10 along three sides of the refrigerator. The heater element 12 is enclosed within a decorative trim channel 14 which is secured over the heater element 12 to protect the same and to provide an aesthetically acceptable appearance of the finished installation.

Figure 2:
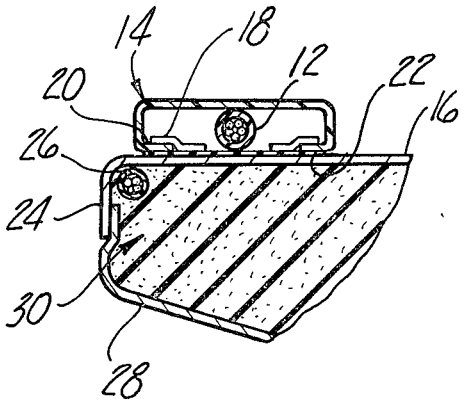
FIG. 2 is a view of the section 2—2 taken in FIG. 1.

As shown in FIG. 2, the trim channel 14 is secured to the outer case 16 as by hidden clips 18 engaging edges 20. The decorative trim channel 14 comprises a roll formed or extruded plastic or metal having a suitable exterior appearance such as to minimize the obtrusiveness of the heater 12 and to render its appearance aesthetically acceptable as noted.

The heater element 12 is advantageously secured to the case 16 by a layer of self-adhesive foil 22 bonded to the outer case 16. The foil improves the conduction of heat into the surrounding cabinet areas and facilitates assembly.

The heater element 12 is installed on the outer case 16 immediately adjacent the reentrant flange 24 whereat the failed heater 26 (or the existing heater tube in those installations where the heater element 12 is installed as a booster) such that the same areas of the outer case may be heated upon energization of the heater element 12.

Accordingly, disassembly of the outer case 16 and the breaker strip 28 or the plastic liner need not be attempted in field repair of a failed heating unit. This also avoids the problem of removing and replacing the heating element in the foamed-in insulation 30.

Figure 3:
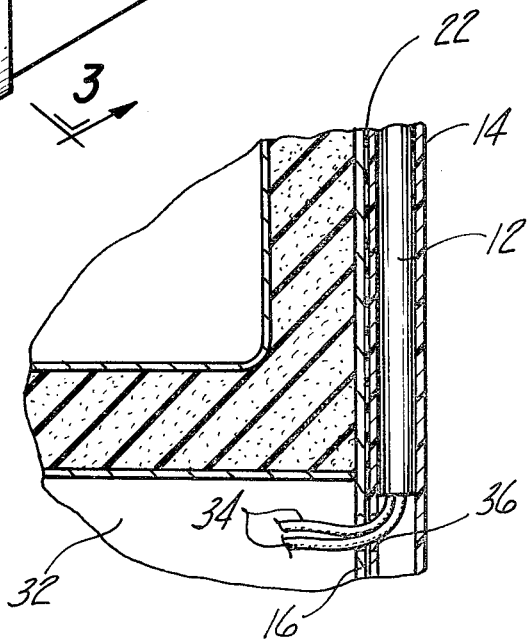
FIG. 3 is a view of the section 3—3 taken in FIG. 1.

FIG. 3 shows the electrical connection of the heater element 12 where drilled openings are formed in the outer case 16 entering the equipment space 32 at the bottommost edge of the refrigerator cabinet 10. The leads 34 are then passed into the opening 36 and connected into the unit wiring harness in the compressor circuit so as to energize the heater element 12 whenever the compressor is running or alternatively directly into the power circuit such that the cabinet heating is activated whenever the unit is in service.

The repair method accordingly involves only the simple procedure of installing a heater element 12 about the cabinet case region subject to condensation and immediately adjacent the reentrant flange 24, and the subsequent installation of a decorative trim channel 14 over the heater element 12. The trim is advantageously divided into three pieces, for this purpose, which are mitered at the corners 38 and 40 to provide a neat finished appearance.

The supplemental heat installation is carried out in similar fashion.

It can thus be appreciated that a simple, straightforward field repair method and installation has been provided by this arrangement in which repair personnel can easily and quickly install the replacement or supplemental cabinet warming installation in the field at relatively low cost. This does not require any change in the design of the refrigerator, nor the use of redundant and costly extra heating elements, nor the foaming-in of heating tubes which require painstaking and tedious snaking of the heater element into and out of the heater tubes both at initial assembly and in field repair. By a simple, add-on installation, the problem of aggravated ambient conditions in which the standard cabinet warming heater is not adequate to prevent cabinet sweating is solved.

It is noted that the term "refrigerator" as used herein is used for the purposes of ease of reference in the broad sense to include freezers, refrigerator-freezers and refrigerators in the narrow sense.

Accordingly, it can be appreciated that the objects of the present invention have been provided. Many variations are of course possible such as alternative configurations of providing an aesthetic treatment of the heating element 12, the particular type of heating element 12, and the particular method of installation thereof.

The embodiments of the invention in which an exclusive property or privilege is claimed are defined as follows:

1. In a refrigerator of the type including a refrigerator cabinet comprised of an outer case having lateral surfaces thereof and at least one access door adapted to be moved into sealing engagement with the door sealing areas on said refrigerator outer case, the combination of a cabinet warming installation, said installation comprising:

a heater element means mounted to the exterior of said cabinet extending about the lateral surfaces of said outer case adjacent said door sealing areas of said cabinet;

means for energizing said heater element whereby said cabinet is warmed by said exteriorly mounted heater element means.

2. The refrigerator according to claim 1 further including a decorative trim secured to said cabinet outer case covering said heater element means.

3. The refrigerator according to claim 1 wherein said means for energizing said heater element means includes openings formed in said outer case at a point adjacent the equipment compartment of said refrigerator, said openings being located beneath said decorative trim.

4. The refrigerator according to claim 1 wherein said heater element means comprises an electrical resistance heating element.

5. The refrigerator according to claim 1 wherein said means energizing said heater element means comprises electrical leads electrically connected to said electrical resistance element, said electrical leads extending through an opening formed in said cabinet outer case adjacent the equipment compartment of said refrigerator, said openings being located beneath said decorative trim.

6. The refrigerator according to claim 4 further including a foil strip secured to said resistance heating element, said foil strip being bonded to said cabinet outer case.

7. The refrigerator according to claim 2 wherein said decorative trim comprises channel means positioned over said heating element means and secured to said refrigerator cabinet outer case.

8. The refrigerator according to claim 6 wherein said channel is provided in sections thereof and each disposed about said lateral surfaces of said refrigerator cabinet.

9. A method of repairing refrigerator units having refrigerator cabinet case heater elements extending within the interior of the refrigerator cabinet about the door sealing areas comprising the steps of:

mounting a heater element on the exterior surfaces of said refrigerator outer case about the surfaces thereof immediately adjacent said door sealing areas.

10. The method according to claim 9 further including the step of mounting a decorative trim over said heater element to said refrigerator cabinet outer case.

11. The method according to claim 9 further including the step of bonding a self-adhesive foil to said refrigerator outer case about said cabinet periphery on said outer case surfaces.

12. The method according to claim 10 wherein said decorative trim comprises a trim channel and wherein in said step of mounting said protective trim, said channel is installed covering said heater element.

13. A method of providing supplemental cabinet warming means for a refrigerator cabinet having cabinet heating means to supplement the heating means and to correct excessive cabinet condensation in extreme humidity conditions, the method comprising:

installing a heater element about the heater cabinet exterior surface areas subject to formation of condensate.

14. The method according to claim 13 further including the step of installing a decorative and protective trim over the heating element.

* * * * *